US010987944B2

(12) United States Patent
Ota et al.

(10) Patent No.: US 10,987,944 B2
(45) Date of Patent: Apr. 27, 2021

(54) TRAY AND PRINTING APPARATUS

(71) Applicant: CANON KABUSHIKI KAISHA, Tokyo (JP)

(72) Inventors: Yasuhiro Ota, Chigasaki (JP); Koya Iwakura, Kawasaki (JP); Shimpei Fujisaki, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/526,622

(22) Filed: Jul. 30, 2019

(65) Prior Publication Data

US 2020/0039242 A1 Feb. 6, 2020

(30) Foreign Application Priority Data

Aug. 1, 2018 (JP) ..... JP2018-145042

(51) Int. Cl.
*B41J 3/407* (2006.01)
*B41J 13/14* (2006.01)

(52) U.S. Cl.
CPC ..... *B41J 3/4071* (2013.01); *B41J 13/14* (2013.01); *B41P 2217/55* (2013.01)

(58) Field of Classification Search
CPC ..... B41J 3/4071; B41J 13/14; B41J 11/13; B41J 2/01; B41J 3/4073; B41J 13/0009; B41P 2217/55
See application file for complete search history.

(56) References Cited

U.S. PATENT DOCUMENTS

| | | | |
|---|---|---|---|
| 5,208,802 | A | 5/1993 | Suzuki et al. |
| 5,542,768 | A | 8/1996 | Rother et al. |
| 6,580,444 | B1 | 6/2003 | Drynkin et al. |
| 6,893,176 | B2 | 5/2005 | Obara |
| 2002/0106493 | A1 | 8/2002 | Komuta et al. |
| 2002/0110399 | A1 | 8/2002 | Murata |
| 2004/0061757 | A1 | 4/2004 | Yanagi et al. |
| 2004/0141791 | A1 | 7/2004 | Obara |
| 2005/0179709 | A1 | 8/2005 | Salisbury |

FOREIGN PATENT DOCUMENTS

| | | | |
|---|---|---|---|
| CN | 1649739 | A | 8/2005 |
| CN | 1703322 | A | 11/2005 |
| CN | 101554805 | A | 10/2009 |

(Continued)

OTHER PUBLICATIONS

IP.com search (Year: 2020).*

*Primary Examiner* — Lisa Solomon
(74) *Attorney, Agent, or Firm* — Canon U.S.A., Inc. I.P. Division

(57) ABSTRACT

A tray is used in a printing apparatus that includes a conveying unit configured to convey the tray holding a printing medium, and a printing unit configured to perform printing onto a print surface of the printing medium held by the tray. The tray includes a placement surface on which a printing medium is to be placed, a pressing member that presses the printing medium placed on the placement surface towards a downstream side of an inserting direction of the tray with respect to the printing apparatus, and a regulating portion configured to regulate a movement of the printing medium by abutting the printing medium pressed by the pressing member.

20 Claims, 11 Drawing Sheets

(56) References Cited

FOREIGN PATENT DOCUMENTS

| | | | |
|---|---|---|---|
| CN | 101654026 | A | 2/2010 |
| CN | 202062817 | U | 12/2011 |
| EP | 1057651 | A2 | 12/2000 |
| JP | H01-213858 | A | 8/1989 |
| JP | H07-98953 | A | 4/1995 |
| JP | 2000-011573 | A | 1/2000 |
| JP | 2000-132874 | A | 5/2000 |
| JP | 2017-213733 | A | 12/2017 |
| WO | 02065471 | A1 | 8/2002 |

* cited by examiner

TRAY AND PRINTING APPARATUS

BACKGROUND OF THE INVENTION

Field of the Invention

The present invention relates to a tray configured to hold a printing medium and a printing apparatus that uses the tray.

Description of the Related Art

U.S. Patent Application Publication No. 20040141791 discloses a disc transporting tray that has a disc-placement recess. A disc holding unit configured to press a disc towards upstream side in a tray inserting direction with respect to a printing apparatus so as to cause the disc to be in contact with a lower surface of the disc-placement recess.

However, in the configuration according to U.S. Patent Application Publication No. 20040141791, when the printing apparatus is configured such that a tray is held between a roller pair and conveyed, there is a possibility of a disc coming off the tray as a result of the disc holding unit malfunctioning when the disc holding unit is nipped by the roller pair.

SUMMARY OF THE INVENTION

Considering the aforementioned circumstance, the present invention provides a tray configured to suitably hold a printing medium.

To achieve the above, the present invention provides a tray that is to be used in a printing apparatus that includes a conveying unit configured to convey the tray that holds a printing medium, and a printing unit configured to perform printing onto a print surface of the printing medium held by the tray. The printing apparatus is configured such that a printed material is produced as a result of the printing medium on which printing is performed by the printing unit being taken out from the tray. The tray includes: a placement surface on which the printing medium is to be placed; a pressing member presses the printing medium placed on the placement surface towards a downstream side of an inserting direction of the tray with respect to the printing apparatus; and a regulating portion against which the printing medium pressed by the pressing member is to be abutted.

Further features of the present invention will become apparent from the following description of exemplary embodiments with reference to the attached drawings.

DESCRIPTION OF THE EMBODIMENTS

Embodiments of a printing apparatus that uses a tray according to the present invention will be described. Note that components described in the embodiments are presented as examples and do not intend to limit the scope of the present invention. In the present specification, description will be provided by presenting, as an example, a serial-type inkjet printing apparatus that includes a printing head configured to discharge an ink with respect to a printing medium conveyed in an intermittent manner and that causes the printing head to reciprocate in a direction intersecting a conveying direction of the printing medium to perform printing. However, the present invention is not limited thereto and is applicable also to a line-type inkjet printing apparatus that uses a long print head to perform printing continuously. In the present specification, "ink" is used as a generic name of liquids, such as a printing liquid. In addition, in the present specification, "printing" is not limited to printing onto a planar object and includes printing onto a three-dimensional object. In the present specification, "printing medium" is used as a generic name of printing media onto which a liquid is discharged, the printing media including, for example, a paper sheet, a fabric, a plastic film, a metal plate, a glass, a ceramic, a wooden material, and a leather.

First Embodiment

Figure 1:
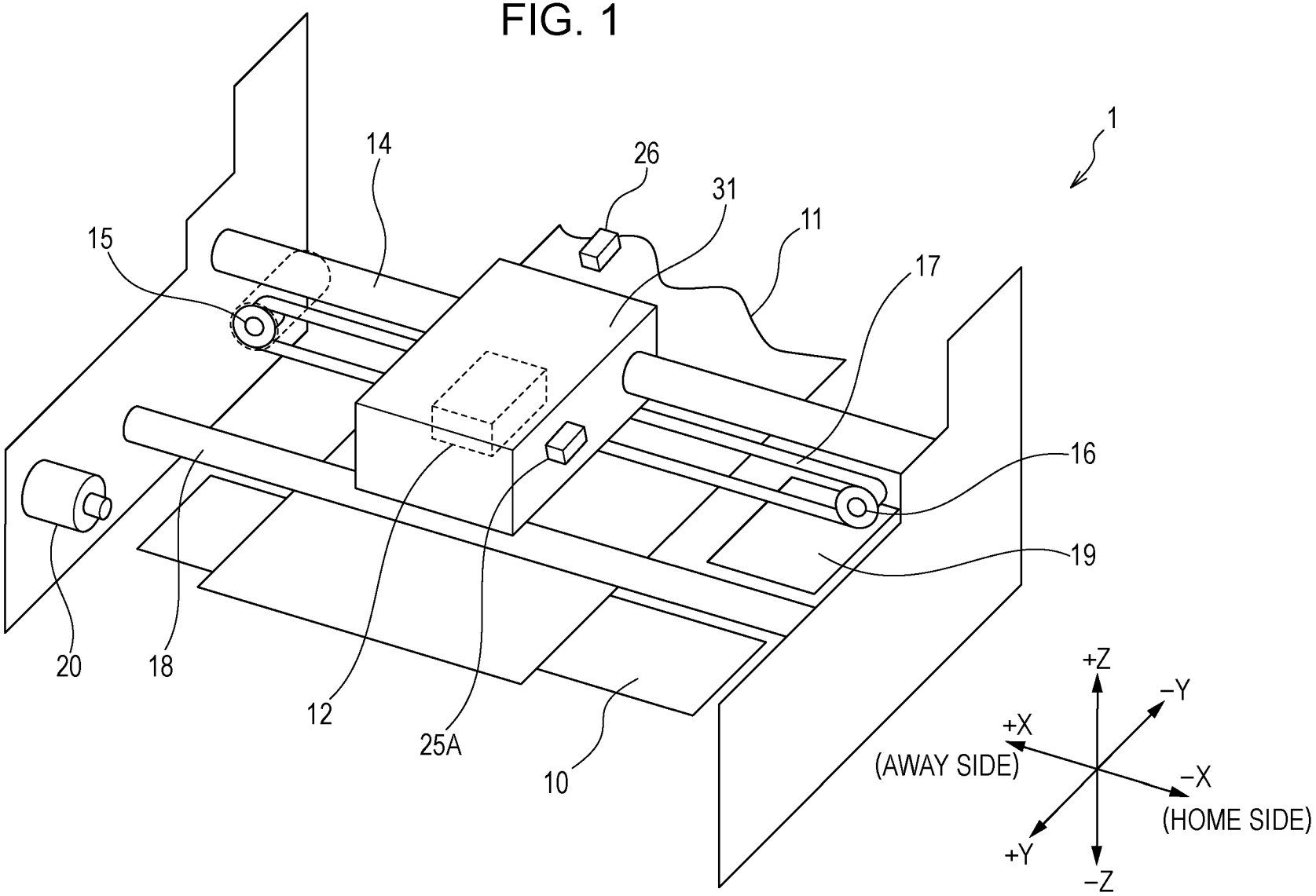
FIG. 1 is a schematic perspective view of a printing apparatus according to a first embodiment.

FIG. 1 is a schematic perspective view illustrating an internal configuration of a printing apparatus 1 according to the present embodiment. The printing apparatus 1 is loaded with a printing head 12 configured to discharge an ink with respect to a printing medium 11 and includes a carriage 31 configured to reciprocate in an X direction. The carriage 31 is guided and supported by a guide shaft 14 so as to be slidable in the X direction. A carriage motor 15 having a pulley is disposed at one end of an area in which the carriage 31 is movable, and an idler pulley 16 is disposed at the other end thereof. A timing belt 17 is stretched around the pulley of the carriage motor 15 and the idler pulley 16, and the carriage 31 and the timing belt 17 are thereby coupled to each other. A support member 18 that extends parallel to the guide shaft 14 is disposed on the downstream side in a +Y direction to suppress the carriage 31 from rotating about the guide shaft 14. The carriage 31 is slidably supported by the support member 18. The X direction is a direction in which the carriage 31 performs scanning and thus is also referred to as a main scanning direction in the following description.

The printing apparatus 1 includes, in the area in which the carriage 31 is movable and in a non-printing area in which printing operation by the printing head 12 is not performed, a maintenance mechanism 19 configured to perform maintenance of the printing head 12. The maintenance mechanism 19 includes, for example, a cap for sealing a discharge-port surface of the printing head 12 during a non-printing period, a wiper for wiping foreign materials and an excess ink adhering to the discharge-port surface, and the like. Hereinafter, a side on which the maintenance mechanism 19 is disposed in the X direction is referred to as a HOME side, and a side opposite to the HOME side is referred to as an AWAY side.

The printing apparatus 1 further includes a conveying unit that includes, for example, a first conveyance roller 13 and a second conveyance roller 22 (refer to FIG. 12) that are driven by a conveyance motor 20. The first conveyance roller 13 is disposed on the upstream side of the printing head 12 in the +Y direction. The second conveyance roller 22 is disposed on the downstream side of the printing head 12 in the +Y direction. The printing medium 11 is conveyed in the +Y direction, which intersects the X direction, by the conveying unit. In the present embodiment, the X direction and the Y direction are orthogonal to each other.

The printing apparatus 1 repeats a printing operation in which the printing head 12 discharges an ink while moving together with the carriage 31 in the X direction and an intermittent conveyance operation in which the conveying unit conveys the printing medium 11 in the Y direction, thereby printing an image onto the entire of the printing medium 11. The printing medium 11 conveyed by the conveying unit is supported at a lower surface thereof by a platen 10 that is disposed at a position opposite the printing head 12.

An edge sensor 26 configured to detect the printing medium 11 is disposed inside a conveyance route along which the printing medium 11 is conveyed by the conveying unit. In the present embodiment, the edge sensor 26 is disposed on the upstream side of the carriage 31 in the +Y direction. The edge sensor 26 may be of an optical type or of a mechanical type.

The printing apparatus 1 can perform printing onto, in addition to a printing medium, such as a paper sheet, a thin plate-shaped printing medium, such as a printable disc (hereinafter referred to as "disc"). To perform printing onto a thin plate-shaped printing medium, a user places the printing medium on a special tray 3 (refer to FIG. 3) to be held thereon and inserts the tray 3 into the printing apparatus 1 in a −Y direction, which is opposite a normal conveying direction (+Y direction). An optical sensor 25A configured to detect the tray 3 that is thus inserted by a user is attached to the carriage 31. The optical sensor 25A is a reflection-type sensor that includes a light emitter and a light receiver.

To perform printing that uses the tray 3, a user inserts the tray 3 between the second conveyance roller 22 and a spur and advances the tray 3 to a predetermined position. When the optical sensor 25A detects the tray 3 inserted to the predetermined position of the printing apparatus 1, the conveyance motor 20 is driven. In response to the driving of the conveyance motor 20, the first conveyance roller 13 and the second conveyance roller 22 rotate in a direction opposite the rotation direction for normally conveying the printing medium and convey the tray 3 in the −Y direction to a position opposite the printing head 12.

The printing apparatus 1 is thus configured to convey both a printing medium, such as a paper sheet, conveyed from the upstream side in the +Y direction and the tray 3 inserted from the downstream side (a side close to the second conveyance roller 22) in the +Y direction. The −Y direction opposite the +Y direction, which is the normal conveying direction, is a direction in which the tray 3 is inserted by a user and, hereinafter, also referred to as an inserting direction.

Figure 2:
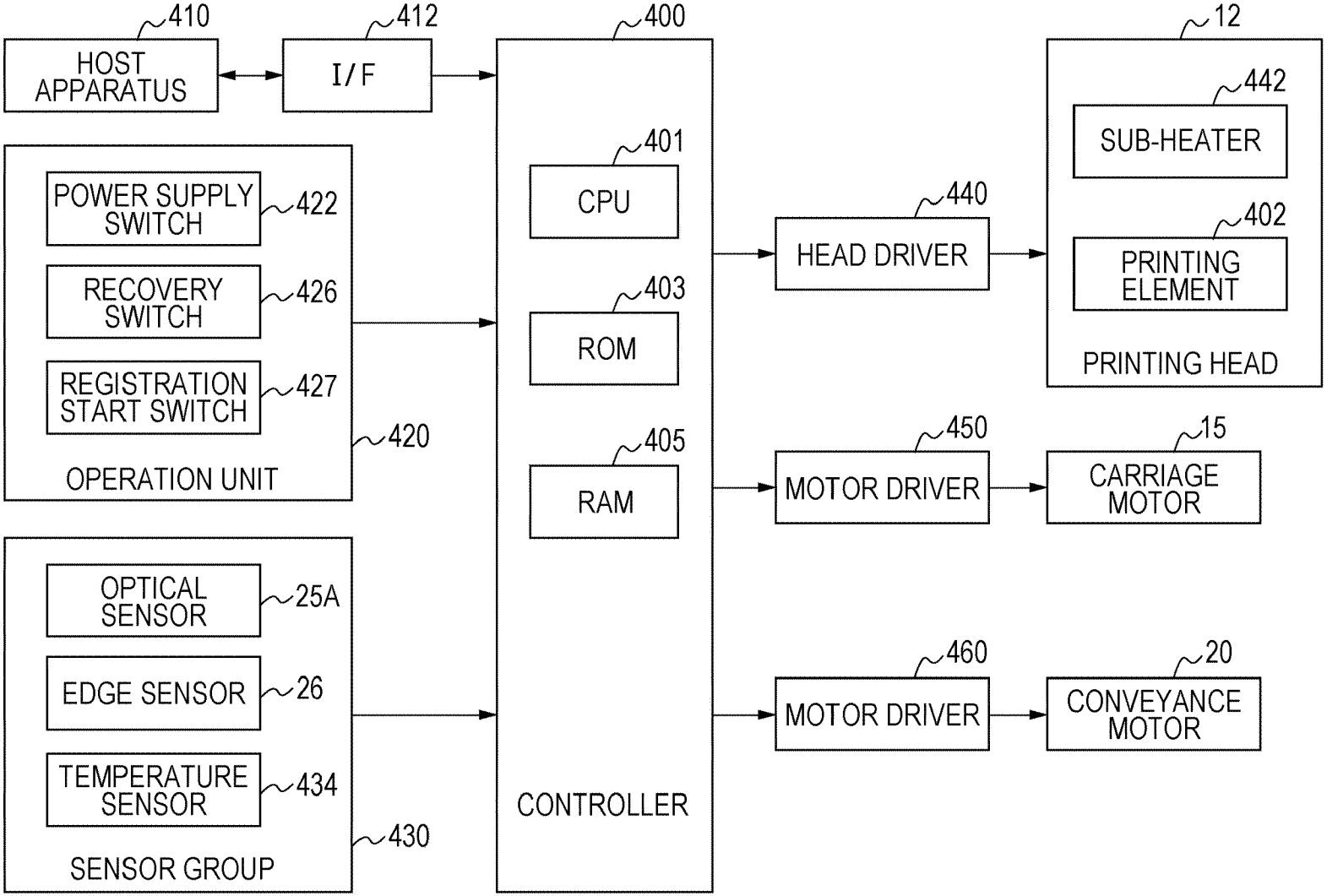
FIG. 2 is a block diagram illustrating a configuration of control of the printing apparatus according to the first embodiment.

FIG. 2 is a block diagram illustrating a configuration of control of the printing apparatus 1. A controller 400 includes a CPU 401 in the form of a micro-computer, a ROM 403 in which programs and other fixed data are stored, and a RAM 405 that includes an area in which image data is rasterized, a work area, and the like. A host apparatus 410 is an image-data supply source connected to the printing apparatus 1 and may be in the form of a personal computer (PC), an image-reading scanner, a digital camera, or the like configured to perform generation, processing, and the like of image data. Image data, other commands, status signals, and the like are transmitted to and received from the controller 400 via an interface (I/F) 412.

An operation unit 420 includes a plurality of switches configured to receive an instruction input by an operator. These switches include a power supply switch 422, a recovery switch 426 configured to provide an instruction to perform a maintenance operation for the printing head 12, and a registration start switch 427 for a user to input a command when executing a registration mode.

A sensor group 430 is configured by a plurality of sensors for detecting a state of the printing apparatus 1. These sensors include the optical sensor 25A loaded on the carriage 31, the edge sensor 26 configured to detect the printing medium 11 in the conveyance route, and a temperature sensor 434 disposed to detect an environment temperature.

The printing head 12 includes a sub-heater 442 configured to perform temperature control to stabilize ink discharge characteristics and a printing element 402 to be used in printing. The sub-heater 442 is in a form of being formed, together with the printing element 402, on a substrate of the printing head 12 or a form of being attached to the body of the printing head 12 or to a head cartridge.

A motor driver 450 is a driver configured to drive the carriage motor 15. A motor driver 460 is a driver configured to drive the conveyance motor 20 that is used to convey the printing medium 11 and the tray 3.

Figure 3:
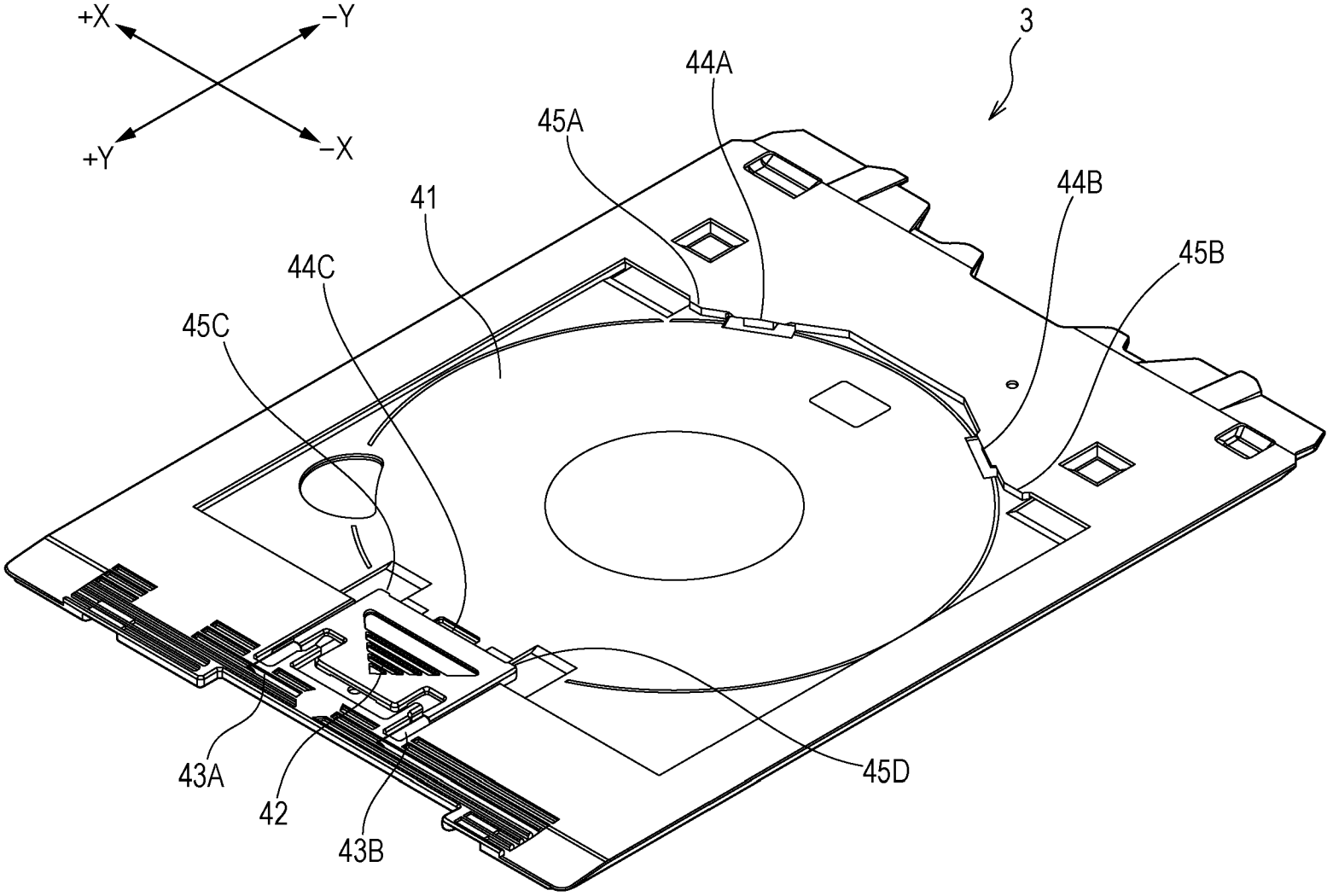
FIG. 3 is a perspective view of a tray that is to be used in the printing apparatus according to the first embodiment.

Next, with reference to FIG. 3, the tray 3 according to the present embodiment will be described. The tray 3 includes, mainly, a recessed portion 41 as a placement surface formed to be lower than the periphery thereof to allow a printing medium to be placed thereon, a slidable pressing member 42 that presses the printing medium 11 placed in the recessed portion 41, and elastic members 43A and 43B configured to urge the pressing member 42. The pressing member 42 is urged towards the downstream side in the inserting direction (−Y direction) of the tray 3 by the elastic members 43A and 43B. The tray 3 includes a first regulating portion 44 and a second regulating portion 45, against which a printing medium placed in the recessed portion 41 and pressed (urged) by the pressing member 42 is abutted to perform positioning of the printing medium.

A head driver 440 is a driver configured to drive the printing head 12. The first regulating portion 44 is disposed at a position that enables, for example, a circular printing medium, such as a disc, to be abutted against the first regulating portion 44. The first regulating portion 44 includes downstream-side first regulating portions 44A and 44B and an upstream-side first regulating portion 44C. The downstream-side first regulating portions 44A and 44B are disposed, on the downstream side of the recessed portion 41 in the inserting direction (−Y direction) of the tray 3, obliquely in the inserting direction of the tray 3 (or in the longitudinal direction of the tray 3) so as to extend along the circular shape of the printing medium. The upstream-side first regulating portion 44C is disposed at a center portion of the pressing member 42 in the X direction, the pressing member 42 being disposed on the upstream side of the recessed portion 41 in the −Y direction.

The second regulating portion 45 is disposed at a position that enables a quadrangular printing medium, such as a later-described mount (adapter), to be abutted against the second regulating portion 45. The second regulating portion 45 includes downstream-side second regulating portions 45A and 45B and upstream-side second regulating portions 45C and 45D. The downstream-side second regulating portions 45A and 45B are disposed, on the downstream side of the recessed portion 41 in the inserting direction (−Y direction) of the tray 3, on the outer side of the first regulating portions 44A and 44B in the X direction. Each of the upstream-side second regulating portions 45C and 45D is disposed at a corresponding one of two end portions of the pressing member 42 in the X direction, the pressing member 42 being disposed on the upstream side of the recessed portion 41 in the −Y direction. In other words, the pressing member 42 is provided with the upstream-side first regulating portion 44C, against which a disc or the like can be abutted, between the upstream-side second regulating portions 45C and 45D.

Figure 4A:
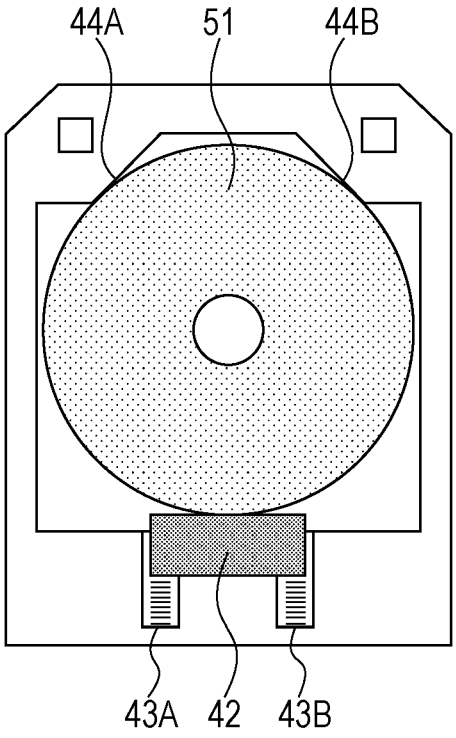
FIGS. 4A, 4B, 4C, and 4D are schematic top views each illustrating a state in which a printing medium is placed and held on the tray according to the first embodiment.

FIGS. 4A, 4B, 4C, and 4D are schematic top views each illustrating a state in which a printing medium is placed and held on the tray 3. FIG. 4A illustrates a state in which a disc 51, as a circular printing medium, is held. Examples of the disc are printable optical discs, such as a CD (compact disc), a DVD (digital versatile disc), and a BD (Blu-ray disc). When the disc 51 is held on the tray 3, an outer edge of the disc 51 is abutted against the downstream-side first regulating portions 44A and 44B and the upstream-side first regulating portion 44C, and positioning of the disc 51 is thereby performed. When the disc 51 is positioned on the tray 3, the disc 51 and each of the second regulating portions 45A to 45D do not abut on each other.

Figure 4B:
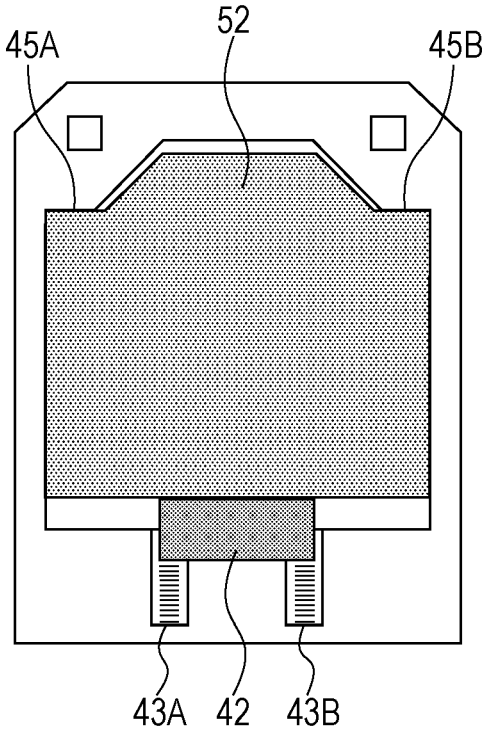

FIG. 4B illustrates a state of holding a mount 52 that has a shape corresponding to the shape of the recessed portion 41 of the tray 3 and that serves as an adapter that allows a printing medium to be placed thereon. When the mount 52 is held on the tray 3, the mount 52 and each of the second regulating portions 45A to 45D abut on each other, and positioning of the mount 52 is thereby performed. When the mount 52 is positioned on the tray 3, the mount 52 and each of the first regulating portions 44A to 44C do not abut on each other.

Figure 4C:
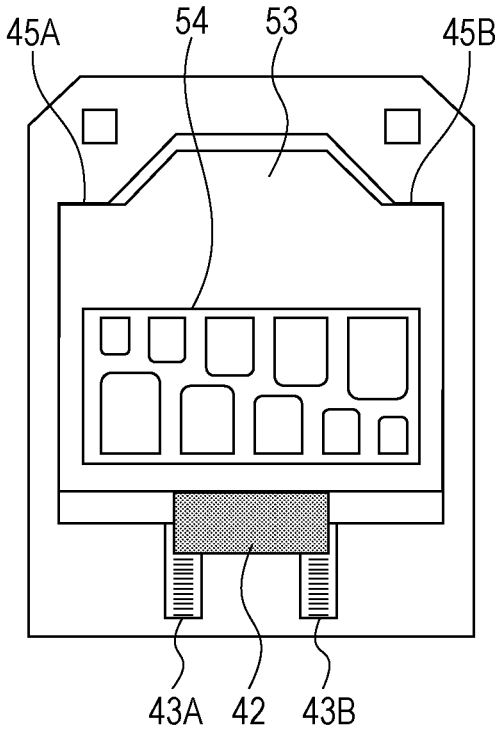
Figure 4D:
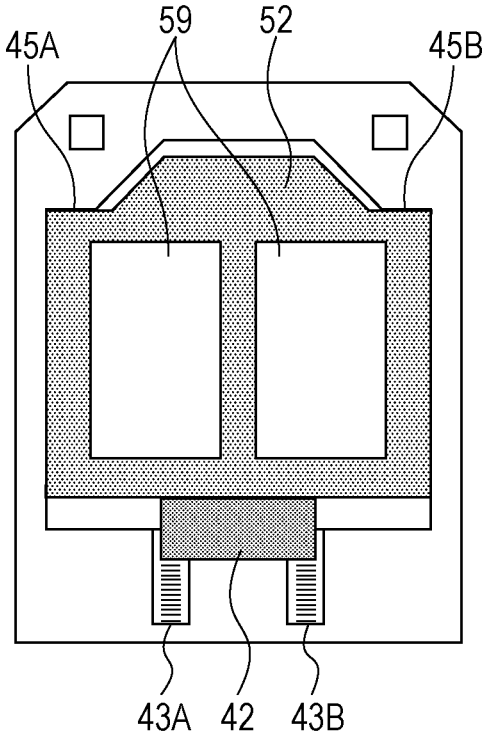

FIGS. 4C and 4D each illustrate an example of a printing medium onto which printing is to be performed using the mount 52. FIG. 4C illustrates a state in which the tray 3 holds a nail-sticker mount 53 that has a shape identical to the shape of the mount 52 illustrated in FIG. 4B. The nail-sticker mount 53 is a mount on which a printing surface 54 for a nail sticker is arranged. When the nail-sticker mount 53 is placed on the tray 3, the printing apparatus 1 is enabled to perform printing for a nail sticker with respect to the printing surface 54.

FIG. 4D illustrates a state of holding the mount 52 that includes a card placement surface 59 on which a card as a printing medium is to be placed. The card placement surface 59 is a recessed portion whose level is lower than the surface of the mount 52 and has a shape in accordance with the outer shape of the printing medium (card). For example, a printing medium, such as a card, for which a regular size is prescribed in JIS or the like can be placed on the card placement surface 59. The depth of the recessed portion of the card placement surface 59 may be determined such that, in a state in which a card is placed on the card placement surface 59, the surface of the card and the surface of the mount 52 are substantially level with each other. Thus, in accordance with the thickness of a card, a through hole or a non-through hole having a predetermined depth is provided in the mount 52 to form the card placement surface 59.

To enable borderless printing using the mount 52 and the nail-sticker mount 53 with respect to a printing medium, such as a card or a nail sticker, at least the outer side of the printing medium may be formed by an ink receiving layer. The mount 52 and the nail-sticker mount 53 may be formed of plastic or the like. The nail sticker and the card are examples of a printing medium onto which printing is performed using the mount 52, and the present invention is not limited thereto.

Figure 5:
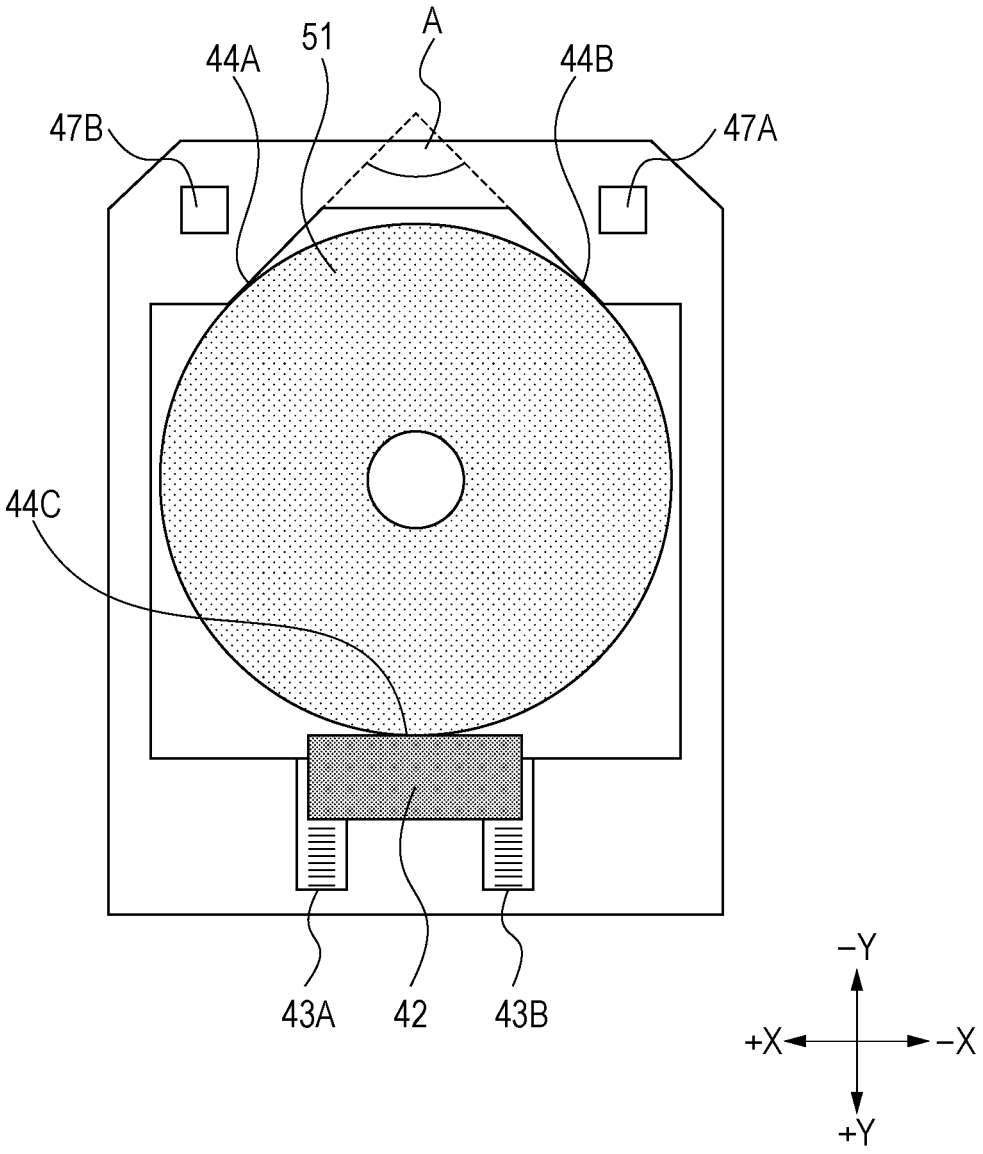
FIG. 5 is an enlarged top view illustrating a state in which a disc is held by a tray according to the first embodiment.

FIG. 5 is an enlarged top view illustrating a state in which the disc 51 is held by the tray 3. The disc 51 is abutted by the pressing member 42 against the downstream-side first regulating portions 44A and 44B and the upstream-side first regulating portion 44C disposed on the pressing member 42, thereby being positioned with respect to the tray 3. In other words, the disc 51 is positioned with respect to the tray 3 by these three first regulating portions 44. The downstream-side first regulating portions 44A and 44B are configured to abut on the outer edge of the placed disc 51 and are disposed bilaterally symmetrical with respect to the center axis of the placed disc 51 in the X direction. In the present embodiment, the downstream-side first regulating portions 44A and 44B are formed by inclined surfaces that each incline to intersect the Y direction and the X direction such that a predetermined angle A is formed by the downstream-side first regulating portions 44A and 44B. The angle A can be 90 degrees or more. The upstream-side first regulating portion 44C is formed to be substantially parallel to the X direction in a state of holding the disc 51.

The tray 3 further includes a first reflective portion 47A and a second reflective portion 47B on the downstream side in the inserting direction (−Y direction). When the tray 3 is inserted into the printing apparatus 1, the optical sensor 25A loaded on the carriage 31 detects the position of each of the first reflective portion 47A and the second reflective portion 47B in the X direction and the Y direction, which enables the printing apparatus 1 to calculate the position of the disc 51.

Figure 6A:
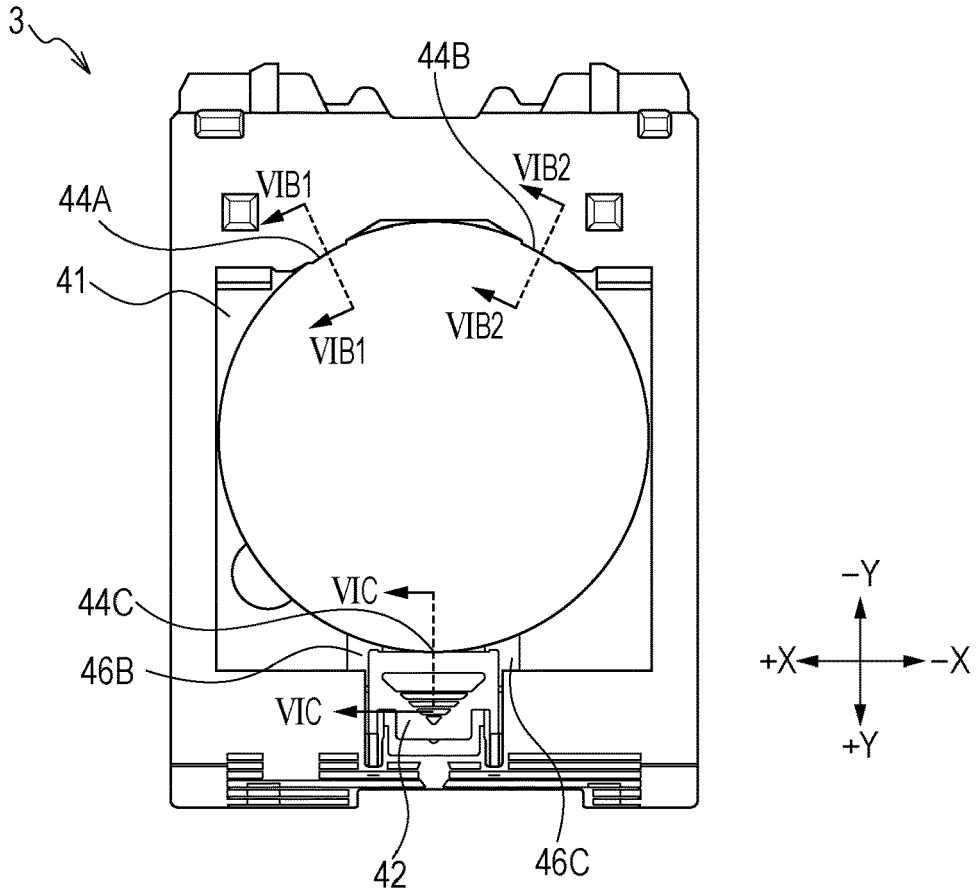
FIGS. 6A, 6B, and 6C each illustrate a configuration of a regulating portion of the tray according to the first embodiment.
Figure 6B:
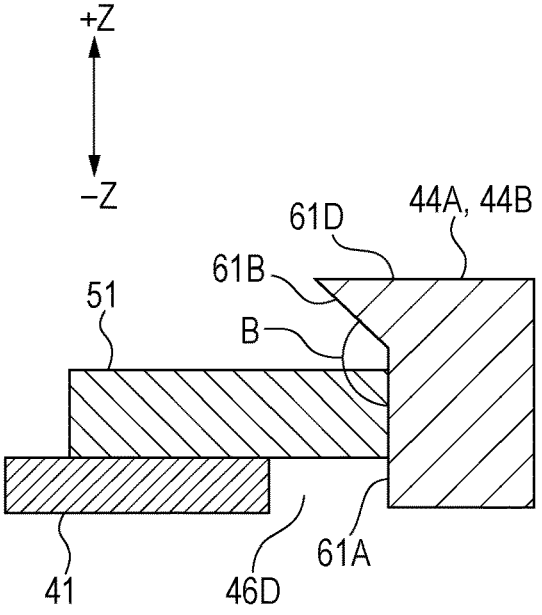
Figure 6C:
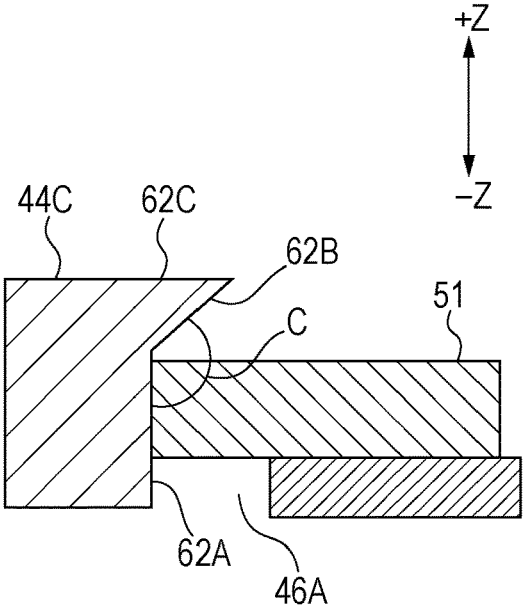

With reference to FIGS. 6A, 6B, and 6C, a detailed configuration of the first regulating portion 44 of the tray 3 will be described. FIG. 6A is a top view of the tray 3 in a state of holding the disc 51. FIG. 6B is a sectional view of the downstream-side first regulating portion 44A sectioned along the line VIB1-VIB1 of FIG. 6A in the Z direction.

As illustrated in FIG. 6B, the downstream-side first regulating portion 44A is constituted by an abutting surface 61A against which the disc 51 is to be abutted and an inclined surface 61B that inclines with respect to the abutting surface 61A. The abutting surface 61A has a length that is larger than or equal to the thickness of the disc 51. The inclined surface 61B is connected to a surface 61D of the tray 3 and projects with respect to a print surface of the placed disc 51. In other words, when viewed from the top, the print surface of the disc 51 is covered by the inclined surface 61B. An interior angle formed by the abutting surface 61A and the inclined surface 61B is a predetermined angle B. The angle B can be 90 degrees or more. A sectional view of the downstream-side first regulating portion 44B sectioned along the line VIB2-VIB2 of FIG. 6A is identical to FIG. 6B, and description thereof is thus omitted.

FIG. 6C is a sectional view of the upstream-side first regulating portion 44C sectioned along the line VIC-VIC of FIG. 6A in the Z direction. The upstream-side first regulating portion 44C is disposed on the pressing member 42, and thus, FIG. 6C corresponds to a sectional view of a portion of the pressing member 42 sectioned along the line VIC-VIC. Similarly to the downstream-side first regulating portions 44A and 44B, the upstream-side first regulating portion 44C is constituted by an abutting surface 62A against which the disc 51 is to be abutted and an inclined surface 62B that inclines with respect to the abutting surface 62A. The abutting surface 62A has a length larger than or equal to the thickness of the disc 51. The inclined surface 62B is connected to a surface 62C of the pressing member and projects with respect to the print surface of the placed disc 51. In other words, when viewed from the top, the print surface of the disc 51 is covered by the inclined surface 62B. An interior angle formed by the abutting surface 62A and the inclined surface 62B is a predetermined angle C. The angle C can be 90 degrees or more.

As illustrated in FIGS. 6A, 6B, and 6C, each of the first regulating portions 44 has an inclined surface that overlaps the print surface of the disc 51 when viewed from the top. Thus, during setting of the disc 51 onto the tray 3 by a user, the user first inserts the disc 51 with respect to the downstream-side first regulating portions 44A and 44B so as to be slipped from below the inclined surface 61B and causes the disc 51 to abut against the abutting surface 61A. Then, after placing the disc 51 in the recessed portion 41 by sliding the pressing member 42 towards the upstream side in the −Y direction against an urging force, the user takes the hand off the pressing member 42, and consequently, the pressing member 42 slides towards the downstream side in the inserting direction (−Y direction) due to the urging force. As a result of the pressing member 42 sliding, the upstream-side first regulating portion 44C disposed on the pressing member 42 and the disc 51 abut on each other, and positioning of the disc 51 with respect to the tray 3 is thereby completed.

The tray 3 further includes an opening 46D (refer to FIG. 6B) in the recessed portion 41 in the vicinity of the abutting surface 61A of the downstream-side first regulating portions 44A and 44B. In addition, as illustrated in FIG. 6C, the recessed portion 41 in the vicinity of the abutting surface 62A of the upstream-side first regulating portion 44C includes an opening 46A. Consequently, a clearance in the Z direction for insertion of the disc 51 by a user is increased, which improves operability.

Figure 7:
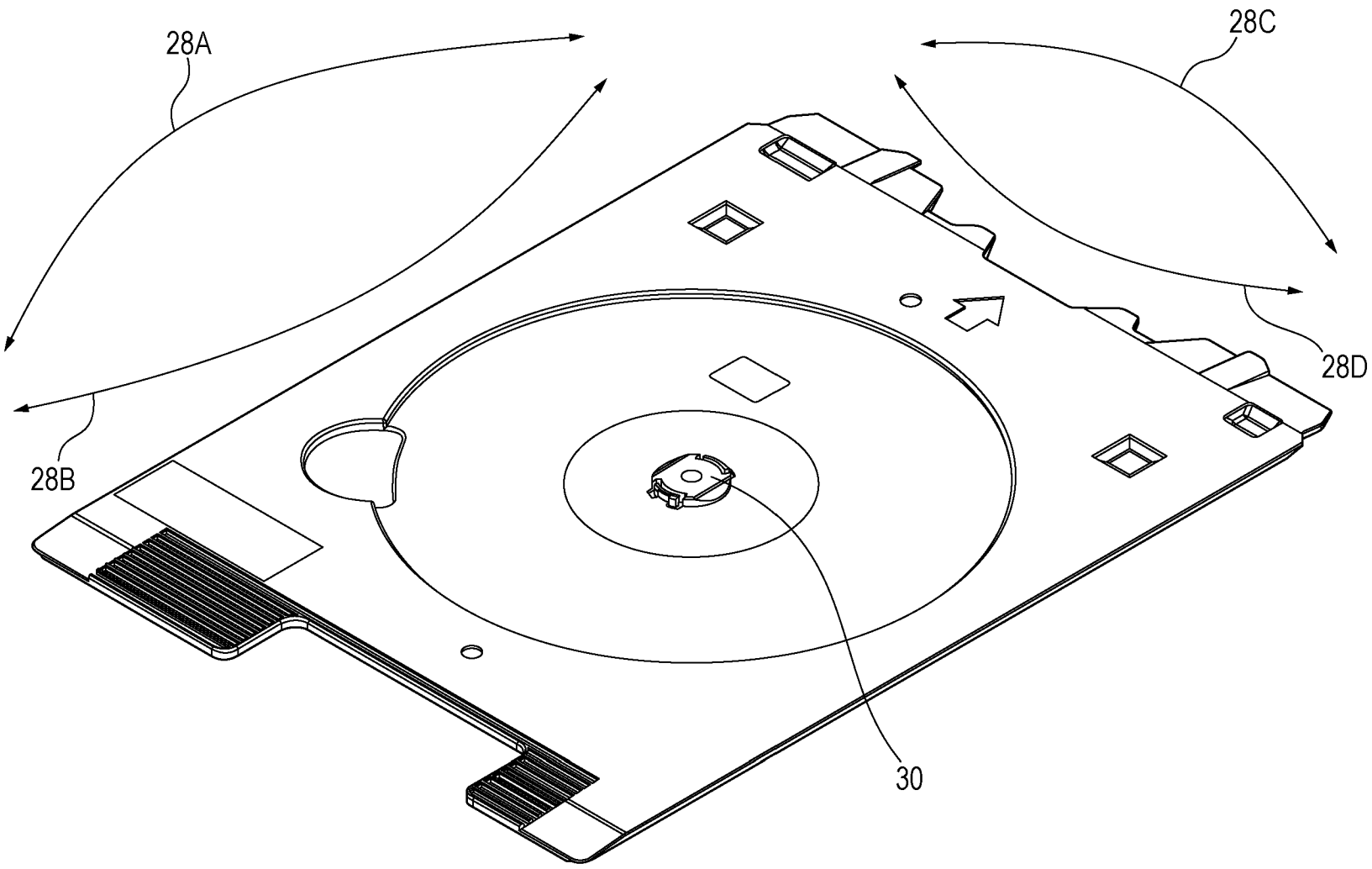
FIG. 7 illustrates a configuration of a regulating portion of a tray of a comparative example.

An effect of the configuration of the first regulating portion 44 will be described by using a comparative example in FIG. 7. FIG. 7 is a perspective top view illustrating an example of an existing tray for disc printing. The existing tray includes a fitting portion 30 at a center portion of a placement surface on which a disc is to be placed. A user fits the fitting portion 30 into a hole at the center of a disc to thereby perform positioning of the disc with respect to the tray. However, there is a possibility of the disc coming off the fitting portion 30 when the user bends the tray, in a state in which the disc is positioned on the tray, such that the tray warps in the directions indicated by the arrows 28A to 28D.

The tray 3 of the present embodiment includes the inclined surfaces 61B and 62B at the first regulating portion 44, with which positioning of the disc 51 is performed. Thus, even when the disc 51 attempts to warp in a direction away from the recessed portion 41 as a result of the tray 3 being bent, the disc 51 abuts against the inclined surfaces 61B and 62B and is suppressed from further warping. Thus, compared to the existing tray, the tray 3 of the present embodiment improves holdability of the disc 51 and has a configuration that suppresses the disc 51 from coming off the tray 3 easily.

Figure 8:
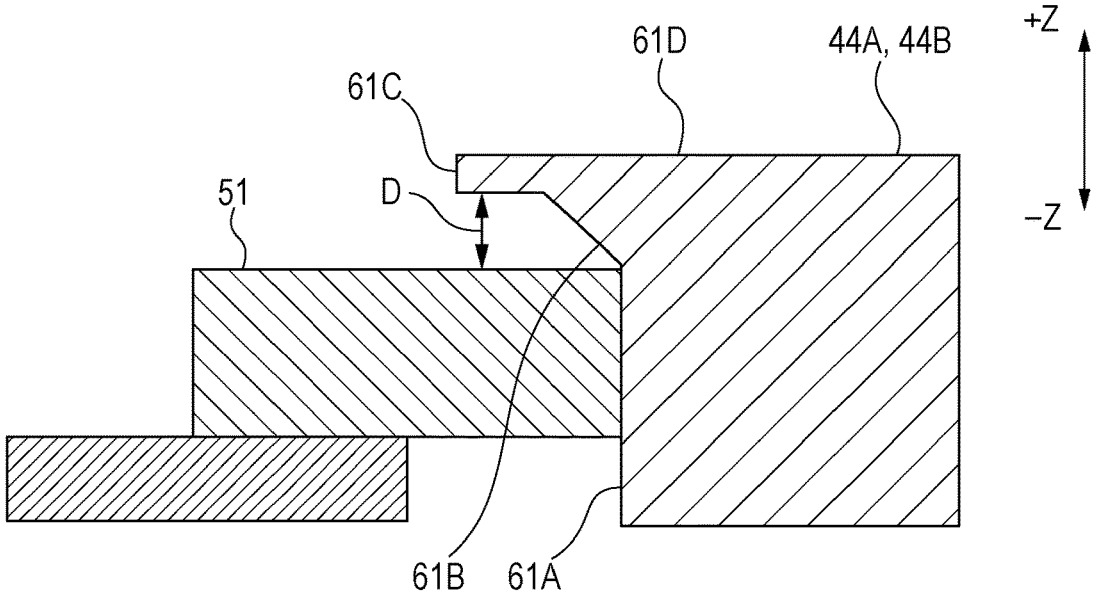
FIG. 8 is a schematic sectional view illustrating a modification of an inclined surface of a regulating portion.

FIG. 8 is a schematic sectional view illustrating a modification of the inclined surface 61B of the downstream-side first regulating portion 44A. In the modification, there is provided a cover portion (cover surface) 61C that is connected to the inclined surface 61B and projects in parallel to the print surface of the placed disc 51. The cover portion 61C is provided, similarly to the inclined surface 61B described in FIGS. 6A, 6B, and 6C, so as to cover the print surface of the disc 51 when viewed from the top. Consequently, compared to a configuration that includes only the inclined surface 61B, the disc 51 is further suppressed from coming off the tray 3, which improves holdability of the disc 51. In this case, a necessary and sufficient clearance D is provided between the cover portion 61C and the print surface of the placed disc 51, which enables the disc 51 to be reliably held regardless of a component tolerance.

Figure 9:
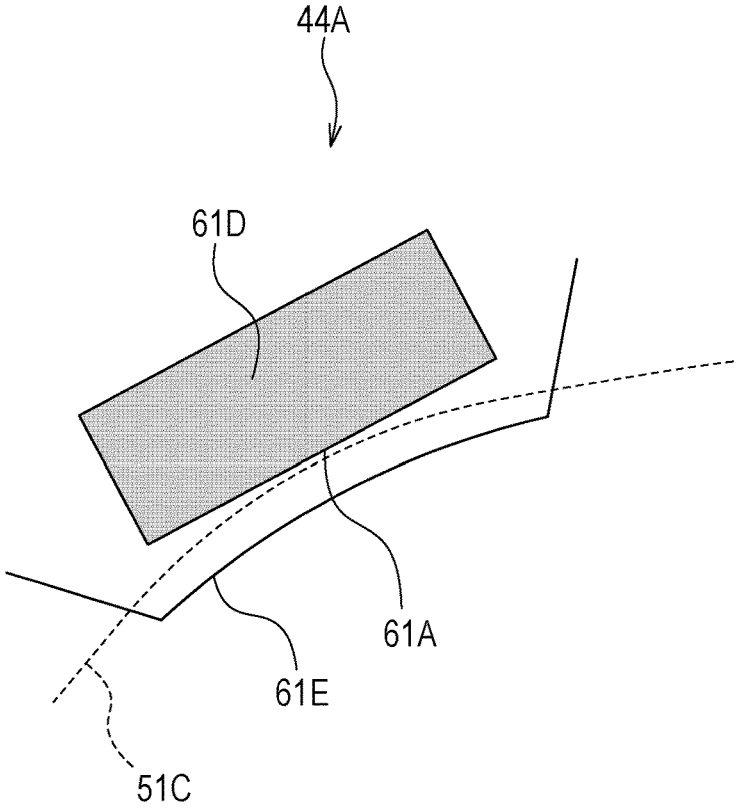
FIG. 9 is an enlarged top view illustrating a second modification of a regulating portion.

FIG. 9 is a schematic enlarged top view of a second modification of the downstream-side first regulating portion 44A and illustrates the vicinity of the downstream-side first regulating portion 44A. The hatched portion 61D is a modification of the abutting surface 61A illustrated in FIG. 6B, and the broken line 51C indicates the outer edge of the disc 51. A curved portion 61E indicated by a curved line corresponds to the inclined surface 61B (or the cover portion 61C) in FIG. 6B and has a shape extending along the outer edge 51C of the disc. Due to the curved portion 61E (the inclined surface or the cover portion) being thus provided in accordance with the shape of the outer edge 51C of the disc 51, holdability of the disc 51 is further improved.

Figure 10A:
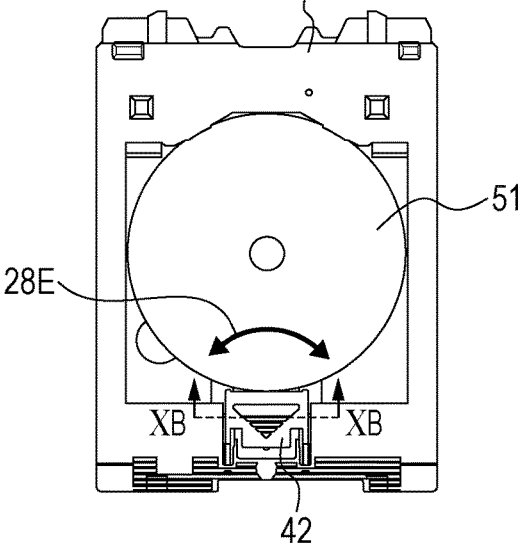
FIGS. 10A, 10B, 10C, 10D, and 10E each illustrate a detailed configuration of a pressing member of the tray according to the first embodiment.
Figure 10B:
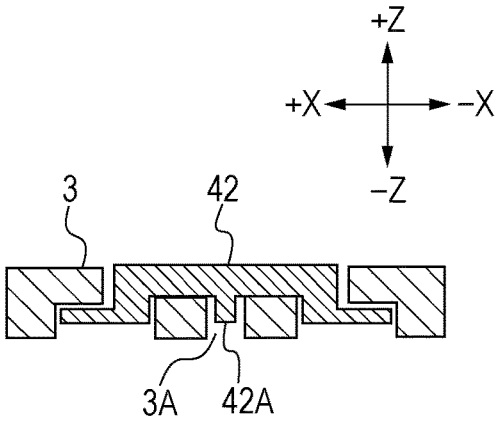
Figure 10C:
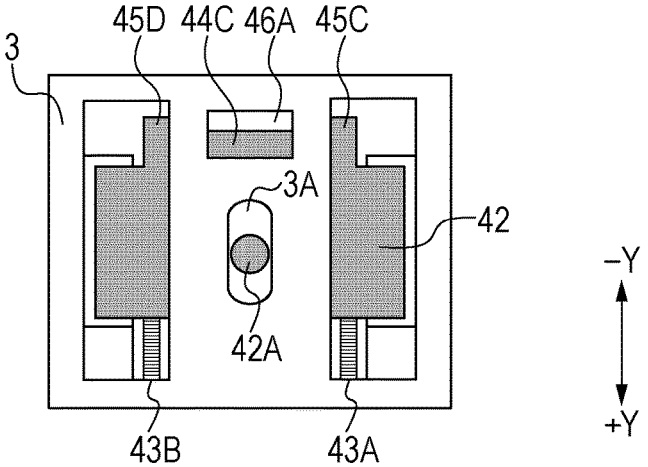

Next, with reference to FIGS. 10A, 10B, 10C, 10D, and 10E, a detailed configuration of the pressing member 42 will be described. FIG. 10A is a top view of the tray 3 on which the disc 51 is held. FIG. 10B is a sectional view of the pressing member 42 sectioned along the line XB-XB of FIG. 10A in the Z direction. FIG. 10C is an enlarged view of the pressing member 42 viewed from the rear side (the side on which a printing medium is not placed) of the tray 3.

As illustrated in FIG. 10C, the pressing member 42 is held so as to be rotatable with respect to the tray 3 due to a boss 42A engaging, so as to be slidable in the Y direction, with an engaging hole 3A disposed in the tray 3. The direction of rotation of the pressing member 42 with respect to the tray 3 is the direction indicated by the arrow 28E in FIG. 10A. The engaging hole 3A is formed to be slightly larger than the boss 42A in the X direction to provide a backlash (refer to FIG. 10B) so that the boss 42A is movable also in the X direction in the engaging hole 3A in accordance with the rotation of the pressing member 42.

The elastic members 43A and 43B are disposed at respective positions in the tray 3 so as to be bilaterally symmetrical to each other with the boss 42A as the center. The elastic members 43A and 43B connect the tray 3 and the pressing member 42 to each other and urge the pressing member 42 in the −Y direction. Consequently, when the disc 51 is not placed at a suitable position, equalization is performed by the elastic force of the left and right elastic members 43A and 43B such that the disc 51 is positioned at the suitable position.

Figure 10D:
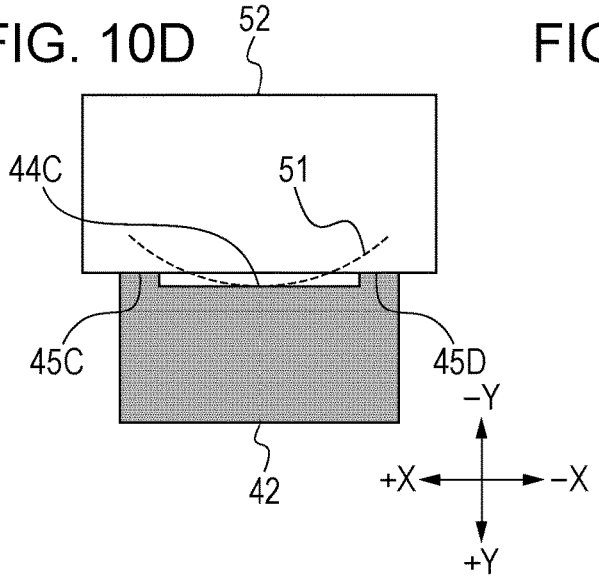

FIG. 10D is a schematic top view illustrating a state in which the pressing member 42 presses the mount 52. For description, the position of the disc 51 while the pressing member 42 presses the disc 51 is indicated by a broken line in FIG. 10D. FIG. 10D illustrates a state of abutting of the mount 52 against the upstream-side second regulating portions 45C and 45D. In the pressing member 42, the upstream-side second regulating portions 45C and 45D are disposed with the upstream-side first regulating portion 44C therebetween. The upstream-side second regulating portions 45C and 45D are disposed at respective positions as not to be in contact with the outer edge of the disc 51 indicated by the broken line and each have a shape projecting from the upstream-side first regulating portion 44C in the −Y direction.

Figure 10E:
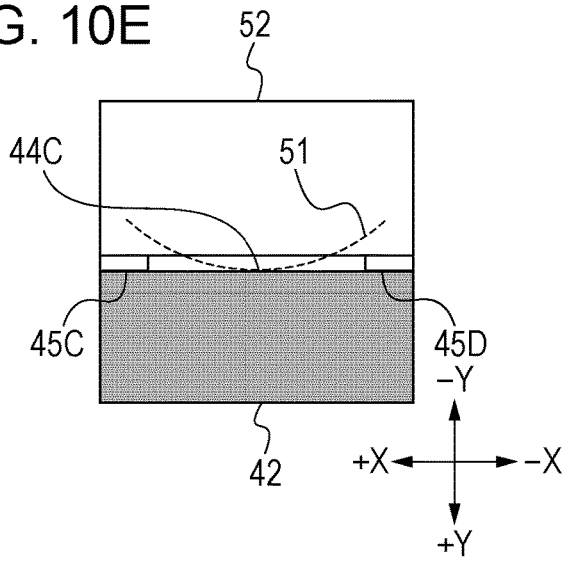

FIG. 10E illustrates a modification of FIG. 10D, in which the upstream-side second regulating portions 45C and 45D are not formed to project in the −Y direction and in which, instead, an area of the mount 52 against which the upstream-side second regulating portions 45C and 45D are abutted projects in the +Y direction.

As described above, to enable the disc 51 and the mount 52 to be placed and held in the recessed portion 41, which is a placement surface, the tray 3 includes the slidable pressing member 42 and the regulating portions that individually correspond to the disc 51 or the mount 52 pressed by the pressing member 42. Consequently, printing media of different types are enabled to be placed on the tray 3 without the need to increase the thickness of the tray 3.

Figure 11A:
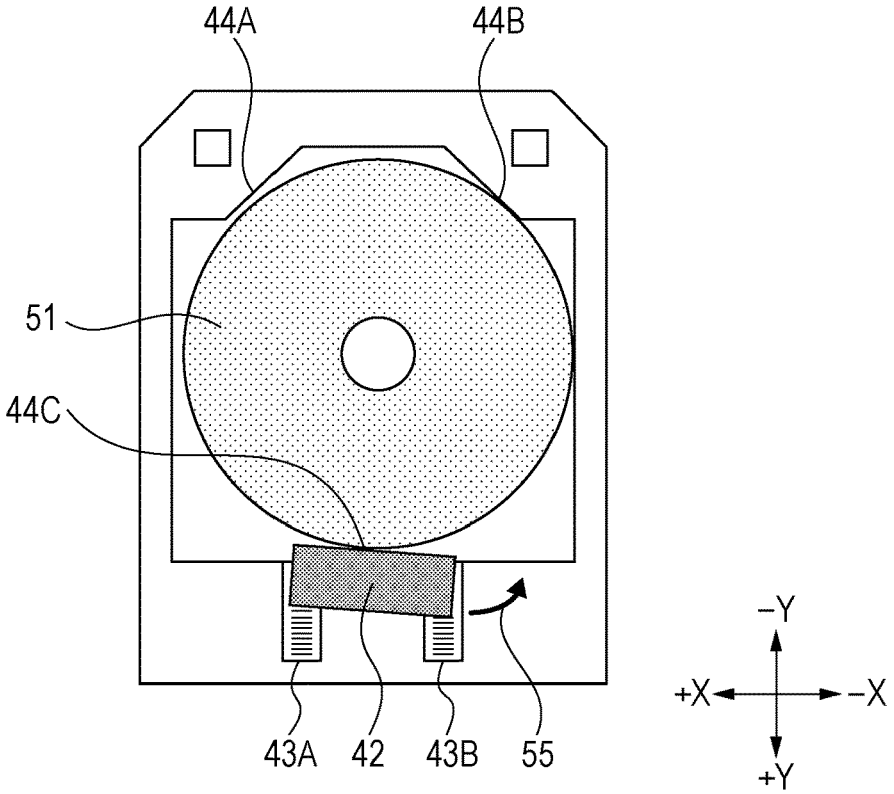
FIGS. 11A and 11B each describe an equalizing function of the pressing member of the tray according to the first embodiment.
Figure 11B:
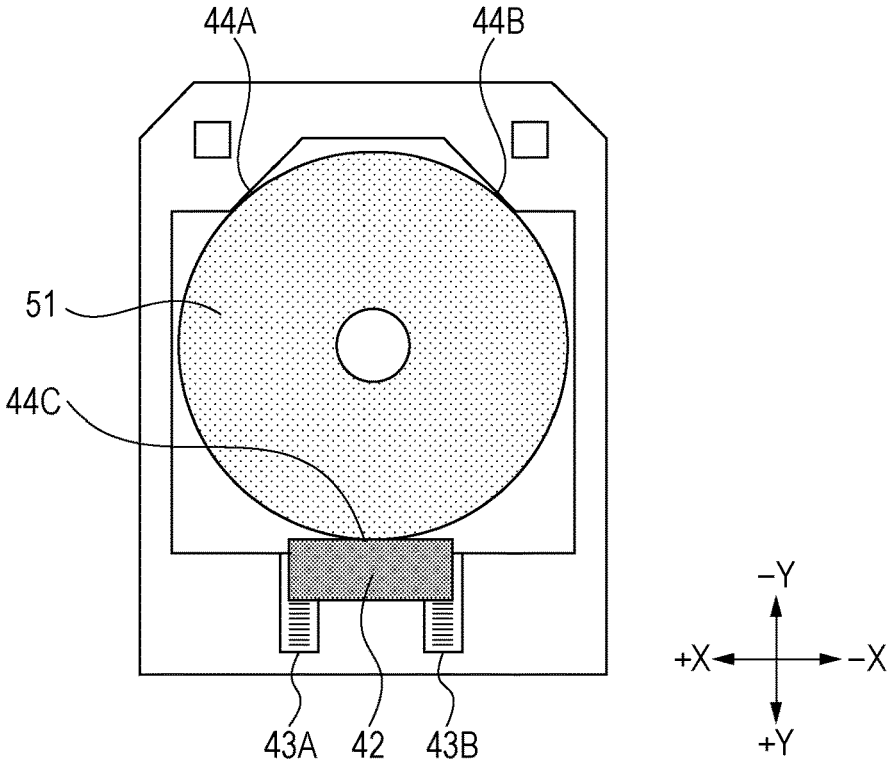

With reference to FIGS. 11A and 11B, the equalizing function of the pressing member 42 will be described. FIG. 11A illustrates a state in which the disc 51 is placed by a user so as to be displaced to the right side of the recessed portion 41. At this time, the disc 51 does not abut against the downstream-side first regulating portion 44A of the tray 3 and is not normally positioned with respect to the tray 3. Therefore, if the user inserts the tray 3 in this state into the printing apparatus 1, there is a possibility of printing being performed at a displaced printing position.

In such a circumstance, in the tray 3 according to the present embodiment, a load that is stronger than a load applied to the elastic member 43A disposed on the left side is applied to the elastic member 43B disposed on the right side, which causes an urging force that resists the load to be generated in the elastic member 43B. Due to the urging force of the elastic member 43B, the pressing member 42 moves in the direction indicated by the arrow 55 until the elastic forces of the elastic member 43A and the elastic member 43B balance each other. Due to the movement of the pressing member 42, the disc 51 disposed so as to be displaced to the right side is moved towards the left side and suitably positioned (refer to FIG. 11B) by abutting against the downstream-side first regulating portion 44A. Similarly, when the disc 51 is placed so as to be displaced to the left side of the recessed portion 41, the disc 51 is suitably positioned due to equalization performed by the pressing member 42.

Figure 12A:
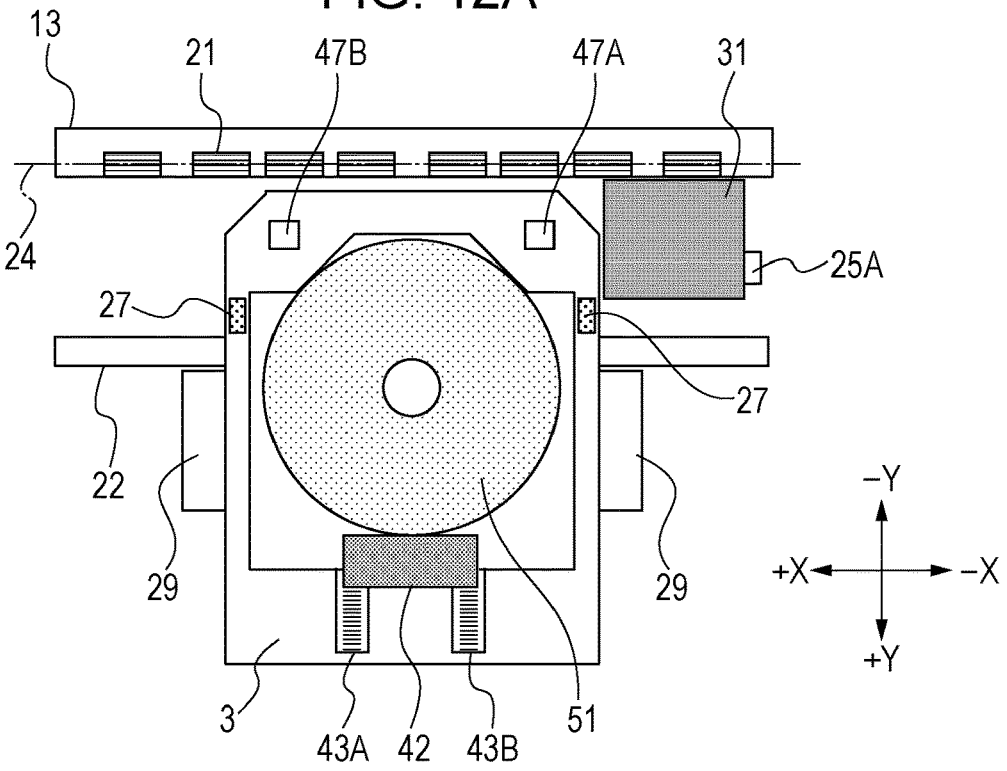
FIGS. 12A and 12B are schematic top views describing a printing operation with respect to a disc held on the tray according to the first embodiment.
Figure 12B:
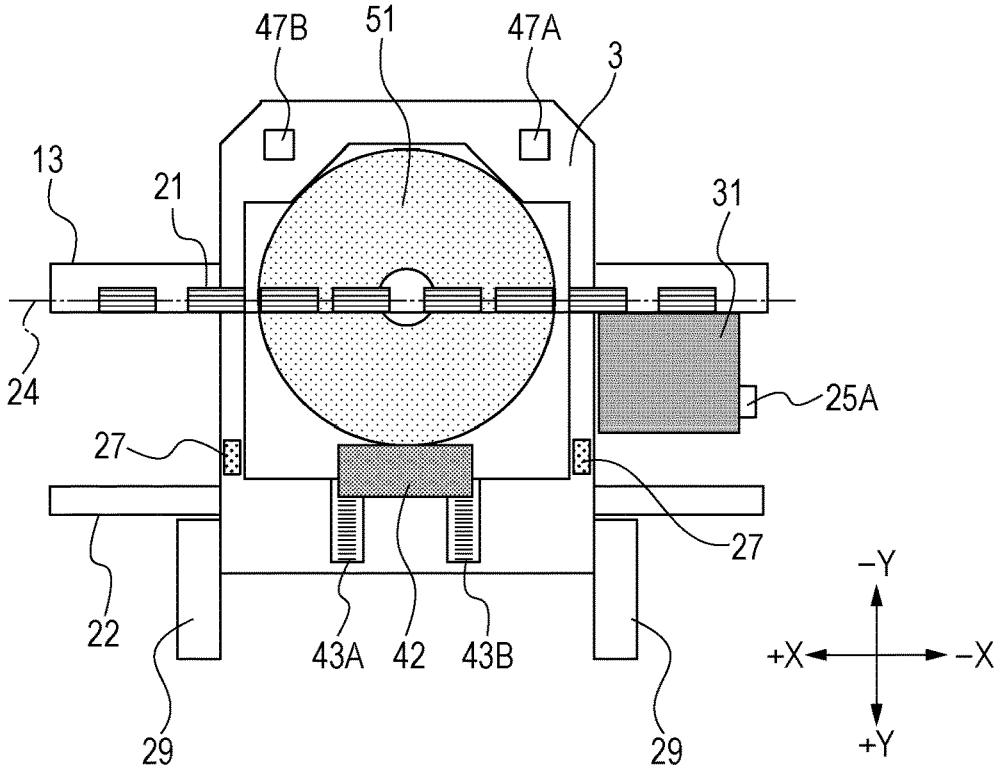

FIGS. 12A and 12B are schematic top views each illustrating a state of a printing operation with respect to the disc 51 held on the tray 3. The printing apparatus 1 includes, as conveying units, the first conveyance roller 13 and the second conveyance roller 22. There are provided a plurality of first follower rollers 21 that are disposed at respective positions opposite the first conveyance roller 13 and that are urged by a spring with respect to the first conveyance roller 13. The printing medium 11 and the tray 3 are held between the first conveyance roller 13 and the first follower rollers 21 and conveyed. A nip formed by the first conveyance roller 13 and the first follower rollers 21 is illustrated as a nip line 24.

The second conveyance roller 22 is disposed on the upstream side of the first conveyance roller 13 in the inserting direction (−Y direction) and is driven together with the first conveyance roller 13 by the conveyance motor 20. The printing apparatus 1 further includes a spur (not illustrated) that is urged by a spring with respect to the second conveyance roller 22 and that is configured to hold and convey the printing medium 11, such as a paper sheet, in cooperation with the second conveyance roller 22. In addition, separately from the spur, there are provided second follower rollers 27 configured to hold and convey the tray 3 in cooperation with the second conveyance roller 22. The second follower rollers 27 are disposed at two locations so that the tray 3 is held at left and right ends thereof in the X direction. The second follower rollers 27 are disposed at respective positions such that the conveyed tray 3 is held at portions thereof on the outer side of the recessed portion 41.

During conveyance of the printing medium 11, such as a paper sheet, by the second conveyance roller 22, the printing medium 11 and the second follower rollers 27 do not come into contact with each other. During conveyance of the tray 3 by the second conveyance roller 22, the spur is lifted by a guide member 29 configured to guide the tray 3 when the tray 3 is inserted by a user, and the tray 3 and the spur thus do not come into contact with each other.

FIG. 12A illustrates a state in which the tray 3 is inserted in the −Y direction by a user. At this time, the guide member 29 functions as a guide for inserting the tray 3 to a suitable position in the X direction. In other words, the tray 3 is restricted by the guide member 29 from being moved or displaced in the X direction. When the tray 3 is inserted to a predetermined position, the carriage 31 moves, and the optical sensor 25A detects the reflective portions 47A and 47B, thereby detecting the position of the tray 3.

When the optical sensor 25A detects the position of the tray 3, the tray 3 is further taken in in the −Y direction, as illustrated in FIG. 12B, as a result of the rotation of the first conveyance roller 13 and the second conveyance roller 22 and conveyed to a print starting position at which printing by the printing head 12 is started.

Here, due to the pressing member 42 being disposed on the upstream side in the inserting direction (−Y direction), even when the tray 3 is conveyed to the print starting position, the pressing member 42 is positioned on the upstream side of the nip line 24 in the −Y direction. In other words, the pressing member 42 is not held between the first conveyance roller 13 and the first follower rollers 21 during a printing operation with respect to a printing medium held on the tray 3. Consequently, the disc 51 is suppressed from coming off the tray 3 as a result of the pressing member 42 malfunctioning by being held between the first conveyance roller 13 and the first follower rollers 21. When the printing operation is completed, the printing medium is taken out from the tray 3 by a user, and consequently, a printed material is produced.

Such a configuration in which the pressing member 42 is disposed on the upstream side in the inserting direction of the tray 3 and urges a printing medium, such as the disc 51, towards the downstream side in the inserting direction and holds the printing medium achieves conveyance of the tray 3 that reliably holds a printing medium.

A form in which, after the tray 3 is inserted and taken in in the −Y direction from the front side of the printing apparatus 1, printing is performed while conveying the tray 3 in the +Y direction has been described as an example; however, the inserting direction of the tray 3 is not limited thereto. In other words, by disposing the pressing member 42 on the downstream side in the inserting direction (+Y direction), the same effect is obtained also in a form in which the tray 3 is inserted in the +Y direction from the back side of the printing apparatus 1 and in which printing is performed in the +Y direction.

The present invention has been described above by presenting, as an example, a printing apparatus that uses an inkjet system; however, the present invention is also applicable to an image forming apparatus that uses an electrographic system.

In other words, the present invention provides a tray configured to suitably hold a printing medium.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-145042, filed Aug. 1, 2018, which is hereby incorporated by reference herein in its entirety.

What is claimed is:

1. A tray configured for use in a printing apparatus that includes a conveying unit configured to convey the tray when the tray holds an optical disc, and includes a printing unit configured to perform printing onto a print surface of the optical disc held by the tray, the tray comprising:

a placement surface configured to receive the optical disc;

a pressing member configured to press the optical disc received on the placement surface towards a downstream side in an inserting direction of the tray with respect to the printing apparatus; and a regulating portion configured to regulate a movement of the optical disc received on the placement surface by abutting the optical disc pressed by the pressing member, wherein the regulating portion includes a cover surface configured to cover a part of the print surface of the optical disc.

2. The tray according to claim 1, wherein the optical disc is a circular disc.

3. The tray according to claim 1, wherein the regulating portion includes:

an abutting surface against which an outer edge of the circular disc is abutted, and an inclined surface that inclines with respect to the abutting surface and that covers a portion of the print surface of the circular disc.

4. The tray according to claim 3, wherein the cover surface is connected to the inclined surface.

5. The tray according to claim 1, the tray further comprising an elastic member configured to urge the pressing member towards the optical disc.

6. The tray according to claim 1, wherein the printing unit is a printing head configured to print an image by discharging an ink.

7. A tray configured for use in a printing apparatus that includes a conveying unit configured to convey the tray when the tray holds a printing medium, and includes a printing unit configured to perform printing onto a print surface of the printing medium held by the tray, the tray comprising:

a placement surface configured to be capable of receiving one of a first printing medium and a second printing medium whose shape is different from the first printing medium;

a pressing member configured to press the printing medium received on the placement surface towards a downstream side in an inserting direction of the tray with respect to the printing apparatus;

a first regulating portion configured to regulate a movement of the first printing medium by abutting the first printing medium pressed by the pressing member, and a second regulating portion differing from the first regulating portion and configured to regulate a movement of the second printing medium by abutting the second printing medium pressed by the pressing member.

8. The tray according to claim 7, wherein the first printing medium is an optical disc.

9. The tray according to claim 7, wherein the second printing medium includes a nail sticker.

10. The tray according to claim 7, wherein the second printing medium includes a card which is placed on a card placement surface of an adapter, and the second regulating portion regulates a movement of the adapter by abutting the adapter pressed by the pressing member.

11. The tray according to claim 8, wherein the first regulating portion includes:

an abutting surface against which an outer edge of the optical disc is abutted, and an inclined surface that inclines with respect to the abutting surface and that covers a part of the print surface of the optical disc.

12. The tray according to claim 8, wherein the first regulating portion includes:

an abutting surface against which an outer edge of the optical disc is abutted, an inclined surface that is connected to the abutting surface and that inclines with respect to the abutting surface, and a cover surface that is connected to the inclined surface and that covers a portion of the print surface of the optical disc.

13. A printing apparatus comprising:

a conveying unit configured to convey a tray when the tray holds an optical disc; and a printing unit configured to perform printing onto a print surface of the optical disc held by the tray, wherein the tray includes:

a placement surface configured to receive the optical disc, a pressing member configured to press the optical disc received on the placement surface towards a downstream side in an inserting direction of the tray with respect to the printing apparatus, and a regulating portion configured to regulate a movement of the optical disc received on the placement surface by abutting the optical disc pressed by the pressing member, wherein the regulating portion includes a cover surface configured to cover a part of the print surface of the optical disc.

14. The printing apparatus according to claim 13, wherein the printing unit is a printing head configured to print an image by discharging an ink.

15. The printing apparatus according to claim 13, wherein the placement surface is capable of receiving one of a first printing medium and a second printing medium whose shape is different from the first printing medium, and the tray includes a second regulating portion configured to regulate a movement of the second printing medium by abutting the second printing medium pressed by the pressing member, the second regulating portion differing from the first regulating portion.

16. A printing apparatus comprising:

a conveying unit configured to convey the tray when the tray holds a printing medium; and a printing unit configured to perform printing onto a print surface of the printing medium held by the tray, wherein the tray includes:

a placement surface configured to be capable of receiving one of a first printing medium and a second printing medium whose shape is different from the first printing medium, a pressing member configured to press the printing medium received on the placement surface towards a downstream side in an inserting direction of the tray with respect to the printing apparatus, a first regulating portion configured to regulate a movement of the first printing medium by abutting the first printing medium pressed by the pressing member, and a second regulating portion differing from the first regulating portion and configured to regulate a movement of the second printing medium by abutting the second printing medium pressed by the pressing member.

17. The printing apparatus according to claim 16, wherein the first printing medium is an optical disc.

18. The printing apparatus according to claim 16, wherein the second printing medium includes a nail sticker.

19. The printing apparatus according to claim 16, wherein the second printing medium includes a card which is placed on a card placement surface of an adapter, and the second regulating portion regulates a movement of the adapter by abutting the adapter pressed by the pressing member.

20. The printing apparatus according to claim 16, wherein the printing unit is a printing head configured to print an image by discharging an ink.

* * * * *